United States Patent [19]

Weiss

[11] 4,307,887

[45] Dec. 29, 1981

[54] AQUATIC GAME DEVICE

[76] Inventor: Jeffrey M. Weiss, 23151 Beverly, Oak Park, Mich. 48237

[21] Appl. No.: 179,330

[22] Filed: Aug. 18, 1980

Related U.S. Application Data

[63] Continuation of Ser. No. 957,464, Nov. 3, 1978, abandoned.

[51] Int. Cl.[3] ..... A63B 63/00

[52] U.S. Cl. ..... 273/411; 272/1 A; 273/1.5 R

[58] Field of Search ..... 273/411, 410, 1.5 R, 273/1.5 A; 4/494; 272/1 A, 1 B; 248/537, 539

[56] References Cited

U.S. PATENT DOCUMENTS

| | | | |
|---|---|---|---|
| 2,130,820 | 9/1938 | Trumbull | 273/411 X |
| 2,818,254 | 12/1957 | Dunn | 273/1.5 R |
| 3,006,705 | 10/1961 | Williams et al. | 272/1 A X |
| 3,339,213 | 9/1967 | Spencer | 4/494 |
| 3,582,078 | 6/1971 | Katras et al. | 273/411 X |
| 3,592,468 | 7/1971 | Simendinger, Jr. | 272/1 B X |
| 3,602,504 | 8/1971 | Chapman et al. | 273/411 X |
| 3,656,749 | 4/1972 | Reyes | 272/1 B X |
| 3,743,287 | 7/1973 | Weinhagen et al. | 272/1 B X |
| 3,794,322 | 2/1974 | Rosenkrans, Jr. | 273/411 |
| 3,823,426 | 7/1974 | Mitchko | 4/494 |
| 3,841,631 | 10/1974 | Dolan | 273/1.5 R |

*Primary Examiner*—William H. Grieb

*Attorney, Agent, or Firm*—Basile, Weintraub & Hanlon

[57] ABSTRACT

An aquatic game device for above ground and in ground home swimming pools is disclosed. The device comprises a pair of spaced apart basketball backboards, with hoop and net, disposed on opposite sides of the pool over the water. The backboards are supported by a pair of upright stanchions which are attached at their lower end to the outer vertical edge of the pool. A volleyball net is suspended between the stanchions. A ball, able to pass through the hoops, is employed to play the game.

9 Claims, 6 Drawing Figures

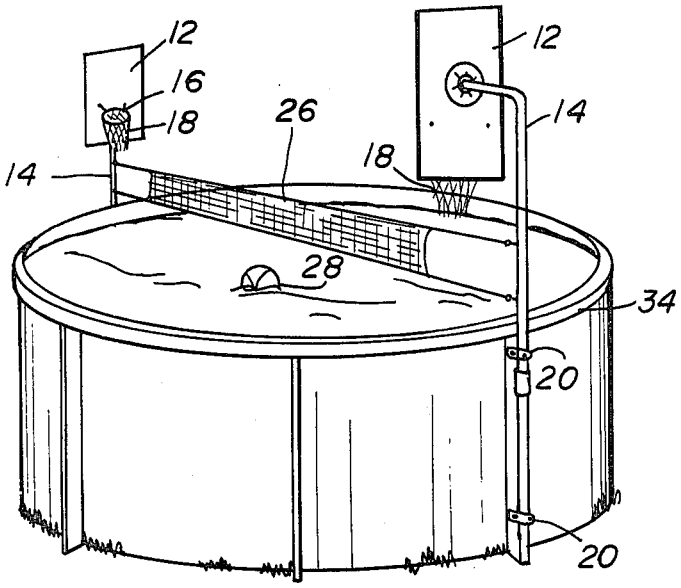
FIG-1
FIG-2
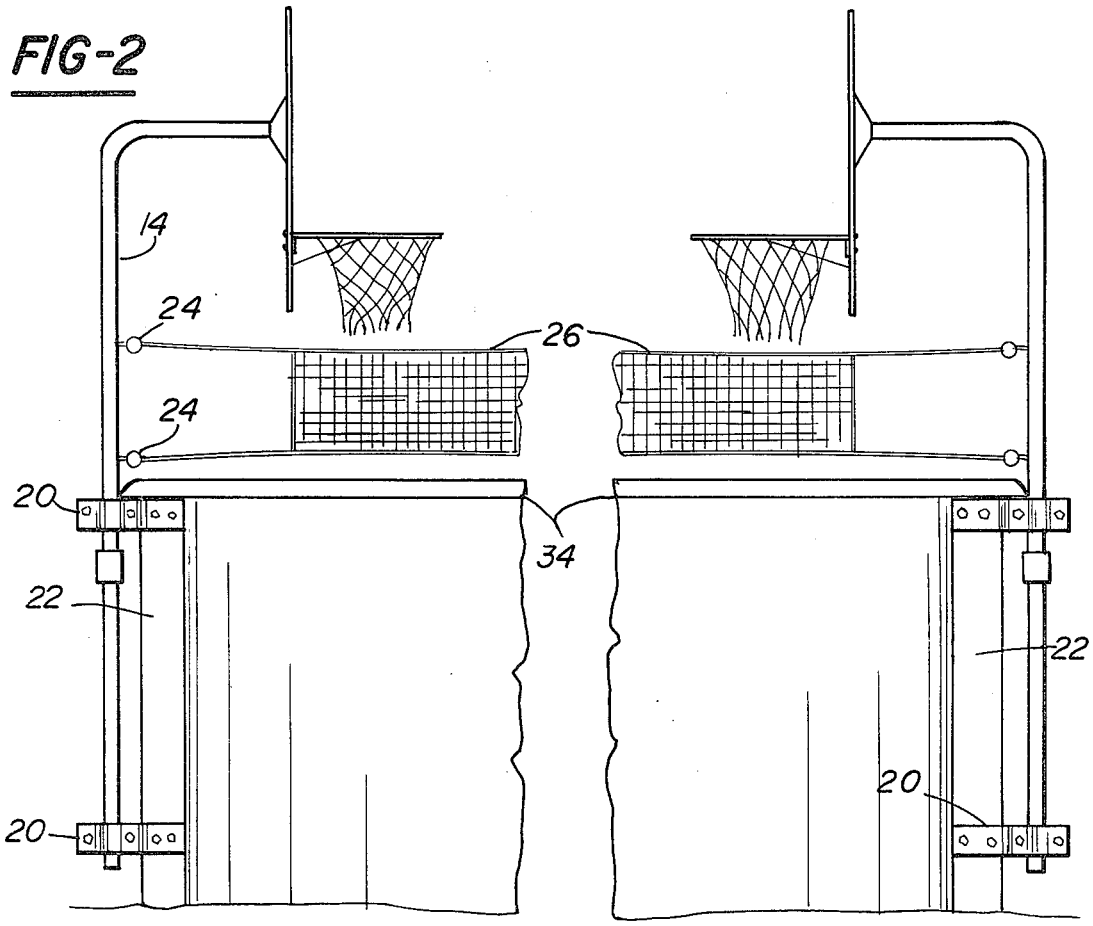

FIG-4
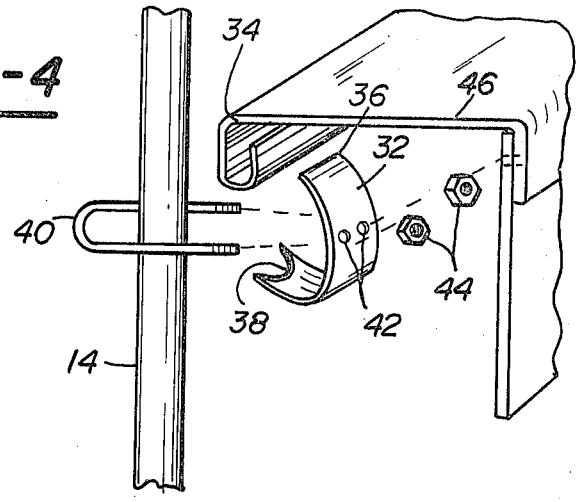
FIG-3
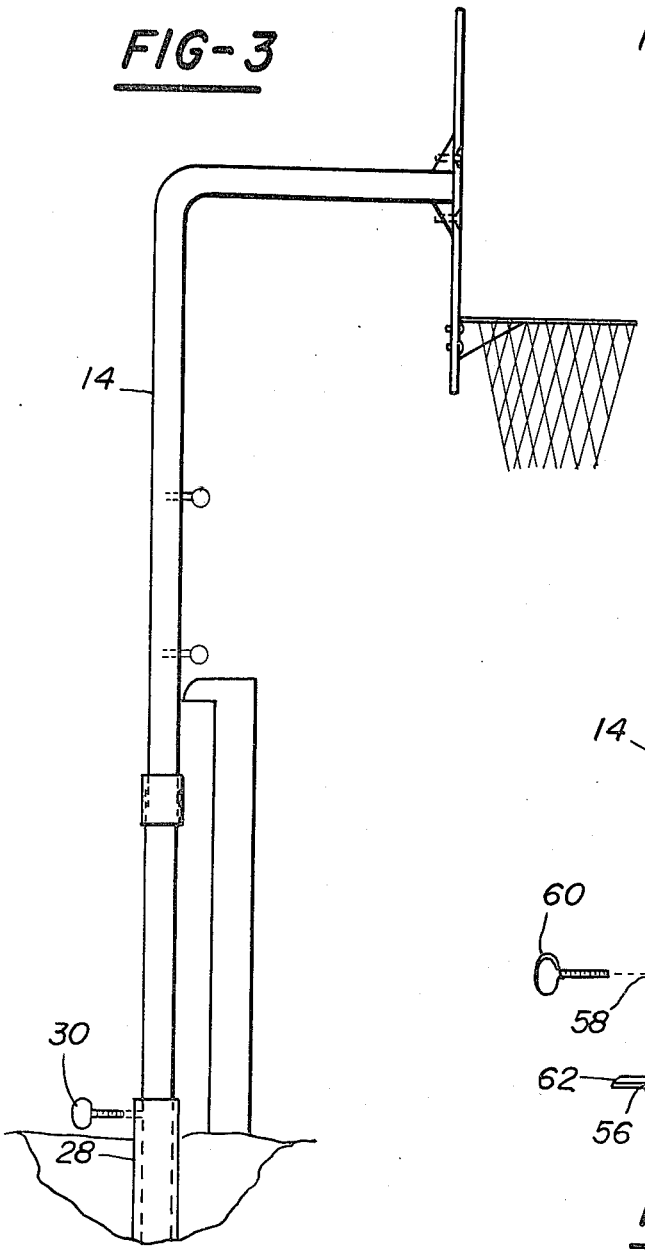
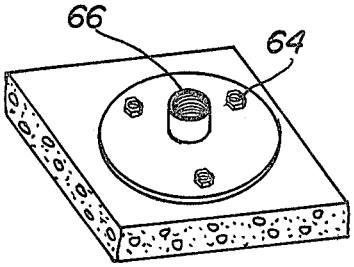
FIG-6
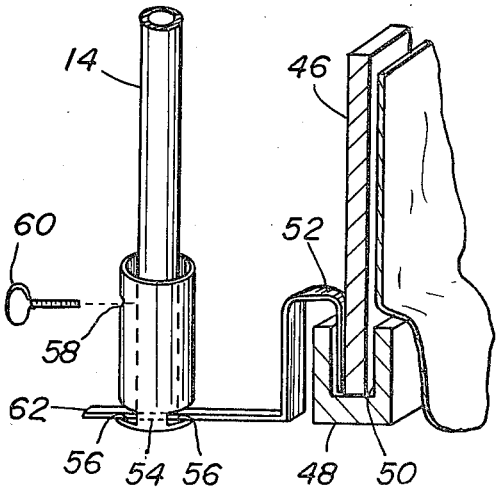
FIG-5

AQUATIC GAME DEVICE

This is a continuation of application Ser. No. 957,464, filed Nov. 3, 1978, now abandoned.

BACKGROUND OF THE INVENTION

I. Field of the Invention

This invention relates to aquatic game devices and in particular to aquatic game devices for backyard above ground swimming pools employing a pair of basketball-type backboards with a hoop and net attached thereto supported over the water by a pair of upright stanchions located at opposite sides of the pool. A volleyball net is strung between the stanchions supporting the backboards.

II. Description of the Prior Art

Numerous aquatic game devices are known in the art. Those known to the inventor which relate to the present invention are: U.S. Pat. Nos. 3,582,078; 3,823,426; 3,656,749; 2,130,820; 3,592,468 and 2,818,254. U.S. Pat. Nos. 2,818,254 and 3,656,749 employ a basketball-type hoop with a net and a ball in the playing of the game in a swimming pool. U.S. Pat. No. 3,582,078 employs a hoop suspended between two vertical stanchions at opposite sides of a pool. None of the above cited patents, however, employ a pair of backboards supported by a pair of vertical stanchions with the backboards having attached thereto a basketball-type hoop and net, with a volleyball net suspended across the pool between the upright stanchions. The above cited patents are the closest art to the present invention that has been discovered by the inventor.

SUMMARY OF THE INVENTION

The present invention is devised to add to the enjoyment of backyard swimming pools which have lately become very popular. The device employs the use of an above ground backyard swimming pool and comprises a pair of vertical stanchions preferably supported by being attached to the outside of the swimming pool along the sides, with the stanchions rising above the surface of the water in the swimming pool. The upper ends of the stanchions curve inward in an arcuate manner over the water terminating when pointed in a horizontal direction a distance inward from the edge of the pool. A pair of vertical basketball type backboards are affixedly attached to the ends of the stanchions. A pair of basketball hoops and nets are attached to the inside face of the backboards. A longitudinal net, such as is used in the game of volleyball, is suspended between the stanchions just above the surface of the water by means of two pairs of spaced apart eyelets attached to the stanchions. A floatable ball of any configurations but not of inordinate weight and small enough to drop through the center of the hoop is employed to play the game. Other objects, advantages and applications of the present invention will become apparent to those skilled in the art of aquatic game devices when the accompanying description of one example of the best mode contemplated for practicing the invention is read in conjunction with the accompanying drawing.

BRIEF DESCRIPTION OF THE DRAWINGS

The description herein makes reference to the accompanying drawings wherein like reference numbers refer to like parts throughout the several views and wherein:

FIG. 1 illustrates the present invention as employed in a backyard-type swimming pool having a round configuration disposed above ground;

FIG. 2 illustrates a view of the device in FIG. 1 taken along a section line 2—2 of FIG. 1;

FIG. 3 illustrates a stanchion, backboard, and basket supported by an inground tube telescopingly receiving the lower end of the stanchion;

FIG. 4 illustrates a stanchion support for above ground pools having a metal coping with a rolled outer edge;

FIG. 5 illustrates an attachment assembly for the base of a pool; and

FIG. 6 depicts an anchor system for use with inground pools.

DESCRIPTION OF THE PREFERRED EMBODIMENT

Referring to the drawings and in particular to FIG. 1 wherein there is illustrated at 10 a preferred embodiment of the present invention comprising a pair of backboards 12 supported by a pair of stanchions 14. A pair of basketball hoops 16 are attached to the inside surfaces of the backboards 12. A pair of basketball nets 18 are suspended from the hoops 16 in the customary manner. The pair of stanchions 14 are supported at their lower end by a pair of spaced apart clamps 20 which are clamped at one end to the stanchion 14 and at the other end to the pool side support 22. Two pairs of eyelets 24 are attached to the stanchions 14, one pair of each stanchion, just above the level of the water to support a volleyball-type net 26 between the stanchions 14. A volleyball 28 is adapted to be thrown through the hoops or across the net 26. Any type of ball, however, can be employed in the game providing it can pass through the hoop and is not so heavy as to put stress on the backboard or the pool itself.

Referring now to FIG. 2, each of the stanchions 14 are supported by a pair of spaced apart clamps 20 attached to one end to the pool side support 22. Each clamp comprises two planar metallic straps disposed on either side of the support 22. A pair of apertures in each strap align with a pair of apertures in the support. A first pair of threaded fasteners pass through the apertures in the support and a first pair of threaded nuts threadingly engage the ends of the first pair of fasteners to fixedly attach the inner end of the pair of straps to the support 22. The outer ends of the pair of straps extend radially outward from the support to encircle the stanchion 14. A pair of aligned apertures through both straps on either side of the stanchion 14 receive a second pair of threaded fasteners. A second pair of threaded nuts threadingly engage the second pair of threaded fasteners to securely tighten the straps to the stanchion 14.

FIG. 3 illustrates another embodiment of the present invention wherein the stanchions 14 are supported at their lower end by a sleeve 28 which is fixedly embedded in the ground near the edge of the pool 22. The stanchions 14 are telescopingly received by the sleeve 28. A wing screw 30 threadingly engages the sleeve 28 to fixedly attach the lower end of the stanchion 14 in the tube 28.

The stanchion support of FIG. 3 can also be used to support the stanchions 14 for use with an "in ground pool." The sleeve 28 is embedded in the concrete deck surrounding the "in ground pool" with the upper end of the tube 28 projecting above the deck surface a distance to provide space for the wing screw 30.

As shown in FIG. 6 where the present invention is installed with an in ground pool after the cement around the pool has previously been poured; a clamp or mounting member such as a plate 64 having an internally threaded hub 66 projecting upwardly from the plate can be affixed to the cement and the stanchion can be threadably connected thereto.

Another embodiment of the stanchion support means is illustrated in FIG. 4 wherein an upper support member 32 is employed having an arcuate form with an upper edge 36 perpendicular to the sides. The upper edge 36 engages the rolled edge 34 of the coping 46, and the lower edge 38 of the upper support member 32 has an arcuate concave shape to engage the outer surface of the stanchion 14. A pair of apertures 42 are disposed in the upper support member 32 to align with and receive the ends of a threaded U-bolt 40. The U-bolt 40 surrounds the stanchion 14 and when the ends of the U-bolt are inserted in the apertures 42, a pair of threaded fasteners 44 threadingly engage the threaded ends of the threaded U-bolt 40 to fixedly engage the stanchion 14 at the coping rolled edge 34. As shown in FIG. 5, the lower end of the pool side wall 46 is supported by a peripheral support member 48 having a groove 50 which engages the periphery of the lower edge of pool side wall 46. A lower support bracket 52 made of flat metal strip is formed in the shape of an inverted "U" at one end. The end leg of the "U" is forced between the pool side wall 46 and the outer edge of the groove 50 and is held in position by friction. The other end of the "U" 52 is formed to extend in a horizontal plane where it reaches the ground extending radially outward from the pool a distance beyond the extension of the coping rolled edge 34. A sleeve 54 sized to telescopingly engage the lower end of the stanchion 14 has a pair of oppositely aligned slots in the sleeve wall near its lower end to slidingly receive the horizontal extension 62 of the lower support bracket 52. A threaded aperture 58 through the wall of the sleeve 54 threadingly receives a wing screw 60. When wing screw 60 is tightened against the wall of the stanchions 14, the stanchion's lower end is securely anchored by friction. The horizontal extension 62 is sized to accommodate a variety of sizes of coping 46.

The number and variety of games that can be played using the present invention is limited only by the imagination of the players. A game combining volleyball and basketball could be played wherein opposing players are lined up on opposite sides of the volleyball net, and as in volleyball the ball is served across the net. A player on the opposing side must catch the ball before it touches the water and throw it through his loop to score a point. Or a player could be required to swim under the net and then throw the ball through his hoop, with opposing players trying to recover the ball. A player could be required to pass the ball or have the option of passing the ball to another player on his team before the ball can be passed through the hoop. A game similar to basketball could be played except that before a player can toss the ball into the hoop in his end of the court, he must first swim under the net before tossing the ball through the hoop. Other variations requiring that the ball be passed immediately before being thrown through the hoop are also possible. Other types of balls can also be used so long as they meet the criteria hereinabove described. The only limitation on the type of ball would be that it is of a diameter capable of passing through the hoop. The use of a ball that does not float, for example, would add variety to the game requiring the players to dive and swim under water to retrieve the ball before passing it through the hoop.

To enjoy this game it need not be played in a pool with deep water. As a means to encourage children to swim the device could be installed at the deep end of the pool. For smaller children who are not able to swim, the play of the game in a shallow pool will develop their muscles and their ability to move quickly through the water further encouraging them to swim.

The game can also be enjoyed playing basketball or volleyball following the conventional rules of play for these games. Basketball can be played wherein the player having the ball must push the ball through the water keeping the ball in continuous motion. When the ball stops the player must pass or shoot.

Another game variation involves the use of one basketball hoop and an upright stanchion disposed across the pool opposite the basketball hoop and a volleyball net suspended between stanchions. The ball must be passed over the volleyball net before a basket can be made.

The present invention, also, contemplates the attachment of goal nets, such as, field hockey nets or the like being attached to the stanchion to further enhance the variety of sports playable herewith.

It should be noted that the stanchions 14 can comprise plural, interconnectable sections to facilitate packaging and transportability. It should be further noted, and is to be appreciated by the skilled artisan, that the present invention is attachable to existing pools without the need of drilling holes or otherwise interrupting the structured integrity thereof.

Having thus described my invention, what I claim is:

1. An aquatic game device for use with an above ground swimming pool comprising:

a pair of opposed spaced apart backboards supported by a pair of vertical stanchions having a pair of basketball-type hoops attached thereto spaced a distance above the water level of an above ground pool; said stanchions attached to an upper and lower portion of the outer wall of said pool; a net attached at each end to said stanchions and suspended therebetween; said net disposed close to the surface of the water; and an upper end of said stanchions curving over an edge of the pool toward the center thereof suspending said backboards over the pool a distance in from the edge.

2. An aquatic game device as defined in claim 1 wherein the stanchions are telescopingly supported at a lower end by a pair of sleeves anchored in the ground outside the edge of the pool.

3. A stanchion support for above ground swimming pools with a coping having a rolled outer edge and a lower support for a pool side wall comprising a peripheral support member having a groove to receive the bottom edge of the side wall comprising:

an upper support member having an arcuate form with an upper edge perpendicular to its sides and a lower edge having a half round concave shape to engage the outer surface of a stanchion, a pair of spaced apart apertures in the upper support member to align with and receive the ends of a threaded "U" bolt surrounding the stanchion, a pair of threaded fasteners to threadingly engage the ends of said "U" bolt, said upper edge abutting the underside of said rolled edge and tightening said threaded fasteners secures the stanchions to said rolled edge;

a lower support bracket formed from flat metal strip having the shape of an inverted "U" at one end, the outer leg of the "U" forced into said groove and retained by friction, the outer leg of the "U" where it reaches the ground is turned outward to form a horizontal end extending a distance beyond the coping, a sleeve telescopingly receives the stanchion end having near its bottom a pair of oppositely aligned slots to slidingly receive the horizontal end of the lower support bracket, a threaded aperture near the upper end of said sleeve threadingly receives a wing screw, tightening said wing screw secures the lower end of the stanchion to the pool side wall, the position of the sleeve is adjustable to accommodate varying coping sizes.

4. The stanchion support as defined in claim 3 further comprising:

a pair of stanchion supports positioned across the pool in an opposed manner;

a pair of opposed backboards supported by the stanchions;

a basketball hoop associated with each backboard; and a net suspended between the stanchions.

5. An aquatic game device comprising:

a pair of opposed spaced apart backboards having a basketball hoop attached thereto supported by a pair of vertical stanchions above the water in an above ground pool;

said stanchions attached to an upper and lower portion of the outer wall of said pool;

a net attached to each end to said stanchions and suspended therebetween, said net disposed close to the surface of the water;

an upper end of said stanchions curving over an edge of the pool toward the center thereof suspending said backboards over the pool a distance in from the edge;

the swimming pool including a coping having a rolled outer edge;

a lower support for a pool side wall comprising a peripheral support member having a groove to receive the bottom edge of the side wall;

an upper support member having an arcuate form with an upper edge perpendicular to its sides and a lower edge having a half round concave shape to engage the outer surface of the stanchion, a pair of spaced apart apertures in the upper support member to align with and receive the ends of a threaded "U" bolt surrounding the stanchion, a pair of threaded fasteners to threadingly engage the ends of said "U" bolt, said upper edge abutting the underside of said rolled edge wherein tightening said threaded fastener secures the stanchion to said rolled edge;

a lower support bracket formed from flat metal strip having the shape of an inverted "U" at one end, the outer leg of the "U" forced into said groove and retained by friction, the outer leg of the "U" where it reaches the ground is turned downward to form a horizontal end extending a distance beyond the coping, a sleeve telescopingly receives the stanchion end having near its bottom a pair of oppositely aligned slots to slidingly receive the horizontal end of the lower support bracket, a threaded aperture near the upper end of said sleeve threadingly receives a wing screw, tightening said wing screw secures the lower end of the stanchion to the pool side wall, the position of the sleeve is adjustable to accommodate varying coping sizes.

6. In combination:

(a) an above ground swimming pool having a side wall, an upper rolled edge coping for supporting the upper end of the side wall and a lower peripheral support for supporting the lower end of the side wall and (b) an aquatic game device which comprises:

(1) a stanchion having an upper end and a lower end, the upper end extending above the upper coping, (2) a first bracket interconnecting the stanchion to the coping, the first bracket including means for engaging the coping and means for engaging the stanchion, (3) fastening means for interconnecting the bracket, stanchion and coping, (4) a lower support for supporting the lower end of the stanchion, (5) means interconnecting the lower support to the lower peripheral support of said pool, (6) a backboard secured to the upper end of the stanchion, and (7) a net and hoop secured to the backboard.

7. The combination of claim 6 which further comprises:

at least a pair of said aquatic game devices, the pair being spaced apart across the width of the pool.

8. The combination of claim 7 wherein:

each stanchion comprises a substantially vertical first leg and a second leg, directed centrally of the pool and substantially perpendicular to the first leg, the backboard being connected to the free ends of the second legs.

9. The combination of claim 8 which further comprises:

a net interconnected to the first legs of the stanchion, below the backboard, and extending substantially across the pool to define a volleyball net.

* * * * *